US009028345B2

(12) United States Patent
Dugdale

(10) Patent No.: US 9,028,345 B2
(45) Date of Patent: May 12, 2015

(54) LAWN GAME AND COMPONENTS THEREOF

(75) Inventor: William C. Dugdale, Chadds Ford, PA (US)

(73) Assignee: Man Shop, LLC, Chadds Ford, PA (US)

( * ) Notice: Subject to any disclaimer, the term of this patent is extended or adjusted under 35 U.S.C. 154(b) by 268 days.

(21) Appl. No.: 13/585,595

(22) Filed: Aug. 14, 2012

(65) Prior Publication Data

US 2013/0045821 A1 Feb. 21, 2013

Related U.S. Application Data

(60) Provisional application No. 61/523,757, filed on Aug. 15, 2011.

(51) Int. Cl.

| | |
|---|---|
| ***A63B 63/00*** | (2006.01) |
| ***A63B 37/00*** | (2006.01) |
| ***A63B 59/10*** | (2006.01) |
| ***A63B 43/06*** | (2006.01) |
| ***A63B 57/00*** | (2006.01) |
| *A63B 53/04* | (2006.01) |
| *A63B 71/02* | (2006.01) |
| *A63B 71/06* | (2006.01) |

(52) U.S. Cl.

CPC ..... *A63B 37/00* (2013.01); *A63B 63/00* (2013.01); *A63B 2053/0416* (2013.01); *A63B 2053/0483* (2013.01); *A63B 59/10* (2013.01); *A63B 43/06* (2013.01); *A63B 57/0056* (2013.01); *A63B 2071/024* (2013.01); *A63B 2071/0625* (2013.01); *A63B 2071/0694* (2013.01); *A63B 2207/02* (2013.01); *A63B 2209/10* (2013.01); *A63B 2210/50* (2013.01)

(58) Field of Classification Search

CPC .. A63B 57/00; A63B 57/056; A63B 57/0062; A63B 63/00; A63B 63/06; A63B 67/02; A63B 67/06; A63B 69/3676; A63B 2071/023; A63B 2071/024; A63B 2071/026

USPC ..... 473/411, 172, 174, 176, 180, 181, 185, 473/189, 195, 170; 273/336–339, 127 R, 273/127 A, 127 B, 127 C, 127 D

See application file for complete search history.

(56) References Cited

U.S. PATENT DOCUMENTS

| | | | | | |
|---|---|---|---|---|---|
| 124,786 | A | | 3/1872 | Brooks | |
| 172,685 | A | * | 1/1876 | Angell | 473/411 |
| 255,596 | A | * | 3/1882 | Chester | 473/411 |
| 838,763 | A | * | 12/1906 | Austin et al. | 273/123 R |
| 960,930 | A | * | 6/1910 | Huckstra | 473/411 |
| 1,112,075 | A | * | 9/1914 | Lush | 473/189 |
| 1,459,615 | A | * | 6/1923 | Cook | 273/336 |
| 1,656,740 | A | * | 1/1928 | Kurtz | 473/185 |

(Continued)

*Primary Examiner* — Mark Graham

(74) *Attorney, Agent, or Firm* — Leason Ellis LLP

(57) ABSTRACT

A pin for a lawn game includes a shaft portion that includes a first end and a second ground contact end. The pin further has a first fence part that is fixedly attached to the shaft portion and radially extends outwardly from the shaft portion and a second fence part that is rotatably attached to the shaft portion and radially extends outwardly from the shaft. The second fence part is sized such that at least a portion of the second fence part is disposed within confines of the first fence part. The second fence part is rotatable relative to the fixed first fence part to allow the second fence part to be positioned at a desired angle, including a right angle, relative to the first fence part. The pin also has a flag disposed at the first end of the shaft portion.

10 Claims, 8 Drawing Sheets

(56) References Cited

U.S. PATENT DOCUMENTS

| | | | | | |
|---|---|---|---|---|---|
| 2,019,302 | A | | 10/1935 | Gibson | |
| 2,041,119 | A | * | 5/1936 | Duganne | 473/176 |
| 2,849,238 | A | * | 8/1958 | Eldredge | 473/180 |
| 3,356,370 | A | * | 12/1967 | Larsen | 473/172 |
| 3,940,143 | A | * | 2/1976 | Jenkins | 473/185 |
| 4,256,308 | A | * | 3/1981 | Schlueter et al. | 473/189 |
| 4,531,736 | A | | 7/1985 | Sahler | |
| 4,880,232 | A | * | 11/1989 | Lang | 473/176 |
| 5,039,103 | A | * | 8/1991 | Sammons | 473/157 |
| 5,101,525 | A | | 4/1992 | Ippolito | |
| 5,897,439 | A | * | 4/1999 | Hohl et al. | 473/176 |
| D609,069 | S | | 2/2010 | Fischer | |
| 8,317,633 | B2 | * | 11/2012 | Maclean | 473/177 |
| 2005/0006846 | A1 | * | 1/2005 | Roy | 273/336 |
| 2006/0089205 | A1 | * | 4/2006 | Yu | 473/180 |
| 2007/0259728 | A1 | * | 11/2007 | Whitefield | 473/185 |
| 2012/0244956 | A1 | * | 9/2012 | Wiggins et al. | 473/174 |

* cited by examiner

LAWN GAME AND COMPONENTS THEREOF

CROSS-REFERENCE TO RELATED APPLICATIONS

The present application claims priority to and the benefit of U.S. Patent Application No. 61/523,757, filed Aug. 15, 2011, which is hereby incorporated by reference in its entirety.

TECHNICAL FIELD

The present invention relates to sports equipment, and in particular, to equipment that is used in lawn games.

BACKGROUND

It is well known that there are a number of different lawn games that are played both as a recreational pastime and as a competitive sport. Some common lawn games include: horseshoes, croquet, bocce, ladder golf, etc. One of the more popular lawn games is croquet which involves hitting plastic of wooden balls with a mallet through hoops (often called "wickets" in the U.S.) embedded into the grass playing court. Croquet can be played in many different ways and there are many variations on the rules and regulations of the game.

SUMMARY

In accordance with the present invention, a lawn game is provided and includes a number of pieces of equipment including a mallet and a ball and a pin or target that is contacted by the ball. The components described herein are for use in a lawn game that is named croquet golf.

In accordance with one embodiment, a pin for a lawn game includes a shaft portion that includes a first end and a second ground contact end. The pin further has a first fence part that is fixedly attached to the shaft portion and radially extends outwardly from the shaft portion and a second fence part that is rotatably attached to the shaft portion and radially extends outwardly from the shaft. The second fence part is sized such that at least a portion of the second fence part is disposed within confines of the first fence part. The second fence part is rotatable relative to the fixed first fence part to allow the second fence part to be positioned at a desired angle, including a right angle, relative to the first fence part. The pin also has a flag disposed at the first end of the shaft portion.

These and other aspects, features and advantages shall be apparent from the accompanying Drawings and description of certain embodiments of the invention.

DETAILED DESCRIPTION OF CERTAIN EMBODIMENTS OF THE INVENTION

In accordance with the present invention, a lawn game is provided and includes a number of pieces of equipment including a mallet and a ball and a pin or target 100 that is intended to be contacted. The components described herein are for use in a lawn game that is named croquet golf. The pin 100 represents a target similar to a wicket in croquet; however, as described herein, the object of the present lawn game is to make contact (strike) with a fence portion 110 of the pin 100 as opposed to croquet in which the object is to pass through the opening of wicket and golf in which the object is to go into a hole. If the player makes contact with any portion of the fence 110, the player has completed the hole and proceeds.

Figure 1:
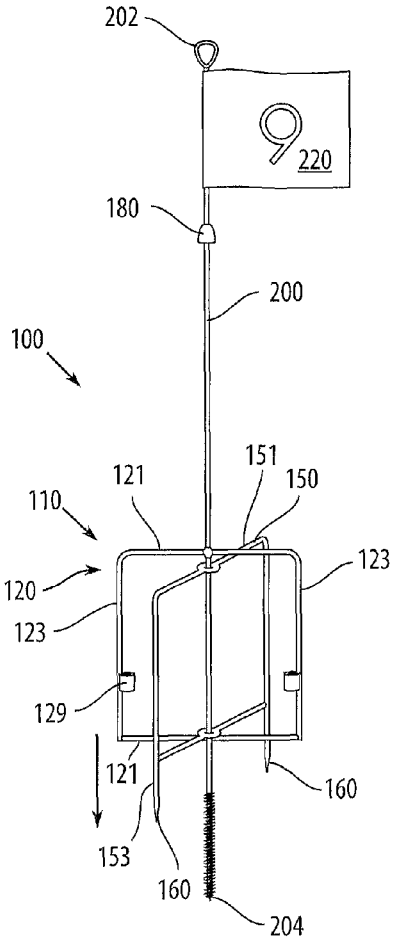
FIGS. 1-3 show a pin (target) according to a first embodiment.
Figure 2:
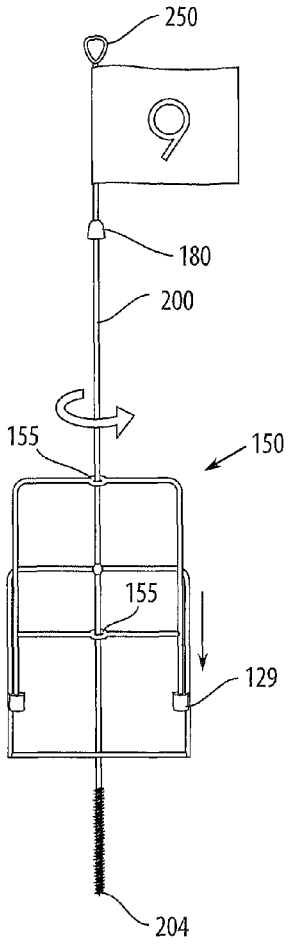

As shown in FIGS. 1 and 2, the pin 100 includes a number of components including the fence portion 110 and a flag or shaft portion 200. The shaft portion 200 is an elongated structure that has a first end 202 and an opposing second end 204. The shaft portion 200 thus resembles a rod-like structure and can be formed of any number of different suitable materials including metal, plastic, etc. In one embodiment, the shaft portion 200 is formed of metal. The first end 202 can be thought of as a flag end, while the second end 204 can be thought of as a ground contacting end (i.e., a stake). The second end 204 can thus be a sharpened end that permits the pin 100 to be inserted and held in the ground in a vertical manner. The second end 204 can include threads so as to resemble a screw pin that is driven into the ground.

At the first end 202, a flag 220 is provided. The flag 220 can be supported in a horizontal manner by a structure, such as a wire of rod or the like that is generally perpendicular to the shaft portion 200. As with other games, the flag 220 has a hole number displayed thereon or has some other type of indicia. The flag 220 can be slipped over the top of the shaft portion 200 and secured by a fastening member (such as a screw on structure 250 as described below).

Figure 3:
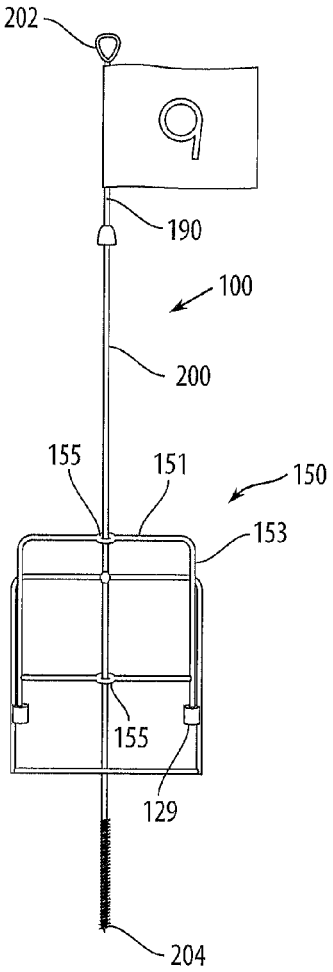

In accordance with one aspect of the present invention, the first end 202 not only includes the flag 220 but also includes an additional feature. For example and as shown in FIGS. 1-3, the first end 202 can include an integral bottle opener structure 250 that is located above the flag 220. The bottle opener structure 250 can be fasteningly secured to the first end 202, such as by a screw top arrangement. In other words, the first end 202 can be a threaded end and the bottom of the bottle opener structure 250 includes complementary threads that mate with the threads of the first end 202. The bottle opener structure 250 can thus secure the flag to the shaft portion 200.

The fence portion 110 is located along the length of the shaft portion 200. The illustrated fence portion 110 is formed of two parts, namely a first fence part 120 and a second fence part 150. The first fence part 120 can be fixedly attached to the shaft portion 200 in a non-rotatable manner, while the second fence part 150 is rotatably coupled to the shaft portion 200. The first fence part 120 can be thought of as an outside target, while the second fence part 150 can be thought of as an inner target. The first fence part 120 is generally square or rectangular shaped with a hollow interior 122. The first fence part 120 is thus defined by a top and bottom horizontal sections 121 (parallel to one another) and two side walls 123 (parallel to one another).

As illustrated, the shaft portion 200 passes through the center of the first fence part 120 and is fixedly attached thereto using conventional means, such as a weld, bond, etc. This arrangement divides the first fence part 120 into two open rectangular shaped structures with the shaft portion 200 in the middle thereof. The fence parts are thus symmetric about the shaft portion 200. The side walls 123 can be spaced a predetermined distance from the shaft portion 200. For example, each side wall 123 can be spaced about 3 inches or 3.5 inches from the shaft portion 200; however, other distances are equally possible. The greater this distance is from the shaft portion 200, the larger the target defined by the first fence part 120 becomes and thus occupies more area and is easier to strike.

As mentioned above, the first fence part 120 does not rotate relative to the shaft portion 120.

Similarly, the second fence part 150 is generally square or rectangular shaped with a hollow interior 152. The second fence part 150 is thus defined by a top and bottom horizontal sections 151 (parallel to one another) and two side walls 153 (parallel to one another).

As illustrated, the shaft portion 200 likewise passes through the center of the second fence part 150 and is rotatably attached thereto. For example, each horizontal section 151 can include a coupling member 155, such as a ring, that has a hollow center that allows the shaft portion 200 to pass therethrough. The two integral rings 155 are axially aligned with one another to allow the shaft portion 200 to pass through. In this manner, the second fence part 150 can freely rotate about the shaft portion 200 and this allows the angle between the second fence part 150 and the shaft portion 200 to be varied. The ability to vary this angle permits the skill level of the game to be varied. In one embodiment, as shown, the second fence part 150 is positioned such that is perpendicular to the first fence part 120. In addition, the second fence part 150 can thus slide up and down at least a length of the shaft portion 200.

As with the first fence part 120, this arrangement divides the second fence part 150 into two open rectangular shaped structures with the shaft portion 200 in the middle thereof. The fence parts are thus symmetric about the shaft portion 200. The side walls 153 can be spaced a predetermined distance from the shaft portion 200. For example, each side wall 153 can be spaced about 1.5 inches or 2 inches from the shaft portion 200; however, other distances are equally possible. The greater this distance is from the shaft portion 200, the larger the target defined by the second fence part 150 becomes and thus occupies more area and is easier to strike.

It will be appreciated that at least a portion of the second fence part 150 lies within the confines of the first fence part 120. For example, the bottom horizontal section 151 can be disposed between the two horizontal sections 121 of the first fence part 120. The bottom horizontal section 151 can thus move up and down along the shaft portion 200 between the two horizontal sections 121.

According to one embodiment, the second fence part 150 is constructed such that the top horizontal section 151 thereof is located above the top horizontal section 121 of the first fence part 120 and similarly, the bottom horizontal section 151 thereof is located above the bottom horizontal section 121 of the first fence part 120. As shown in FIG. 2, the second fence part 150 can thus be raised relative to the first fence part 120.

Figure 4:
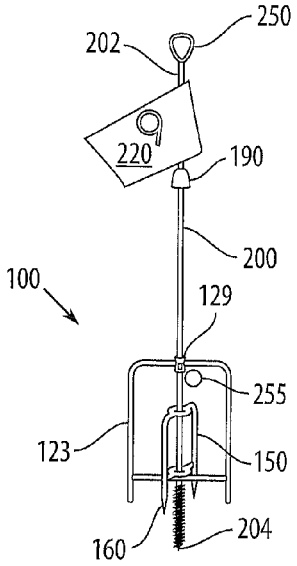
FIGS. 4-5 show a pin (target) according to a second embodiment.
Figure 5:
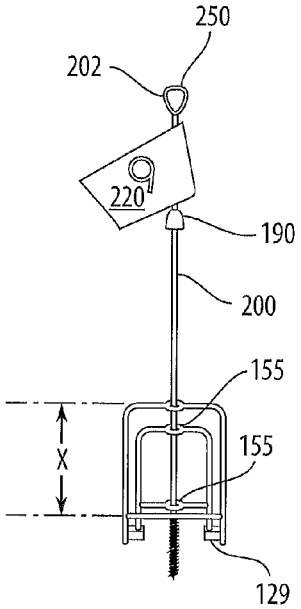

In one embodiment, the sizes of the first and second fence parts 120, 150 can be substantially equal or as shown in FIGS. 4 and 5 they can be different sizes.

The shaft portion 200 and the first and second parts 120, 150 can be made of any number of suitable materials including but not limited to heavy gauge iron or steel.

In order to provide a staking action, the bottom horizontal section 121, 151 of the two fence parts 120, 150 can include one or more ground staking (anchoring) members 160, such as a pointed downwardly directed tip that is driven into the ground. For example, the ends of the bottom sections 121, 151 can include pointed stakes 160. Alternatively, one or both of the parts 120, 150 can not include the stakes 160 in which case the bottom sections rest against the ground. The lengths of the anchoring members 160 can be selected based on intended use and can vary; however, in one embodiment, the anchoring members 160 can be about 1 inch in length.

The sides of the "fence" are spaced so that a human foot can step on the bottom bracket and of the fence to push it into the ground. The pin 100 is spun or pushed into the ground until the bottom of the outer fence part touches the ground. The inner fence part is rotated to a perpendicular position relative to the outer fence part or to a desired angle and the inner fence part is then pushed into the ground. Once the anchoring elements 160 are in the ground, the screw pin 100 is secure and can no longer spin until the pin 100 is pulled out. Thus, the relative angles between the two fence portions are fixed once anchored into the ground.

To permit easy storage, the side walls 123 of the first fence part 120 can include locking sheaths or loops (hollow tubes) 129 that allow the stakes 160 of the second fence part 150 to be received and thereby secure the two fence parts 120, 150 to one another, with the two fence parts 120, 150 being substantially parallel to one another and in an overlying relationship. As shown in FIG. 3, to store the pin 100, the second fence part 150 is rotated about the shaft portion 200 into contact with the first fence part 120.

FIGS. 4 and 5 show another embodiment in which the second fence part 150 is disposed between the horizontal sections 121 of the first fence part 120. More specifically, the top horizontal section 151 is below the top horizontal section 121 and the bottom horizontal section 155 is above the bottom horizontal section 121. One anchoring element 160 is disposed on one side of the bottom horizontal section 121 and the other anchoring element 160 is disposed on the other side of the bottom horizontal section 121. The distance between the horizontal sections 121 for the first part 120 is selected to allow the second part 150 to be lifted up (disengaged from the ground) and rotated to allow different position of the second part 150 relative to the first part 120 (i.e., part 150 can assume a perpendicular orientation and the storage position in which it is substantially parallel).

It will also be appreciated that in the embodiment of FIGS. 4 and 5, the first fence part 120 includes anchoring elements 161 that extend below the bottom horizontal section 121 thereof. The anchoring elements 160, 161 serve to securely anchor the fence parts 120, 150 into the ground.

As shown, in one design, in the play and storage modes of FIGS. 4 and 5, respectively, the top horizontal section 151 of the second part 150 is spaced below, by a predetermined distance, from the top horizontal section 121 of the first part 120.

An audible feature is added to the pin 100 to alert a person that contact has been made between the ball and the pin 100. For example, a bell or the like 180 can be provided along the shaft portion 200 near the flag and is designed to make a noise when the pin 100 is struck with the ball. The bell can be coupled to the shaft portion 200 using conventional means 182, such as a split ring or fastener, etc. A stop 190 can be provided on the shaft portion 200 underneath the flag to limit the downward movement of the flag. In addition, the bell can be associated with a ring structure that receives the shaft portion 200 through the open center thereof and the ring can rest against the joint (weld) formed between the first fence part 120 and the shaft portion 200.

Figure 6:
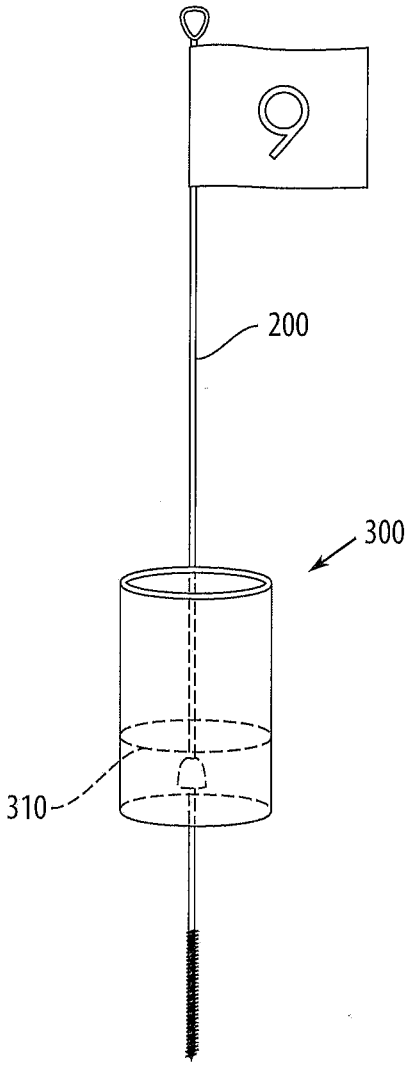
FIG. 6 shows a pin (target) according to a second embodiment.

In another embodiment shown in FIG. 6, the target portion of the pin 100 can be in the form of a cup holder 300. The cup holder 300 is a hollow structure, such as a cylindrical shaped member that can receive a store a cup. The cup holder 300 can include an intermediate transverse wall 310 that divides the cup holder 300 into two sections, namely, a top section that is sized to receive a cup and a bottom section that includes a bell or other member that makes an audible noise. The wall 310 is thus substantially parallel to the ground. In this design, the cup holder 300 is attached to the shaft portion 200 along the side wall of the cup holder 300 so as to not interfere with reception of a cup into the cup holder 300. The cup holder 300 thus extends radially outward from the shaft portion 200.

It will be appreciated that the threaded portion of the shaft portion 200 allows for easier insertion into the ground which can be hard in many situations. The entire pin 100 can spin and rotate until the ground anchoring elements 160, if present, are embedded into the ground.

Figure 7:
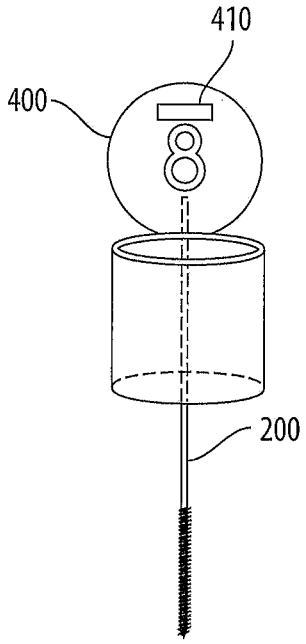
FIG. 7 shows a pin (target) according to a third embodiment.

FIG. 7 shows a combination of a cup holder and bottle opener in a single product. In other words, the top end of the shaft portion 200 includes a flag 400 that displays indicia, such as a number, relating to the associated hole and also includes a slit 410 formed therein that serves as a bottle opener.

Figure 8:
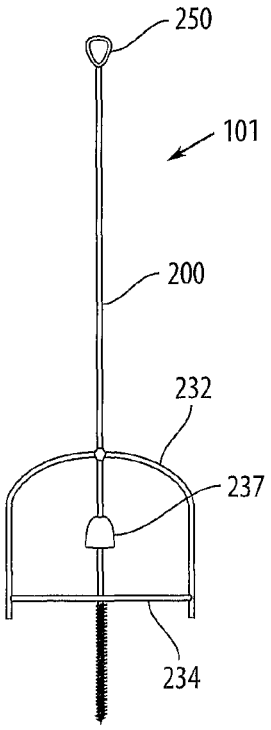
FIGS. 8 and 9 show a pin (target) according to a fourth embodiment.
Figure 9:
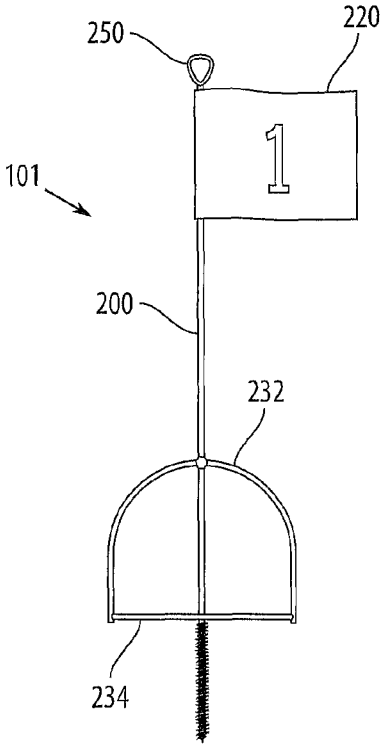

FIGS. 8-9 show other embodiments of a pin and fence portion 101 according to one embodiment of the present invention. The portion 101 includes a number of components similar to previous designs and therefore, like elements are numbered alike. The portion 101 includes shaft 200 and flag 220 and has a fence part 230 that has a rounded top horizontal section 232 and a linear, bottom horizontal section 234 with anchor elements 235 extending below. A central bell 237 can be provided within the fence part 230 and can be formed integral to the shaft 200 or attached thereto.

Figure 10:
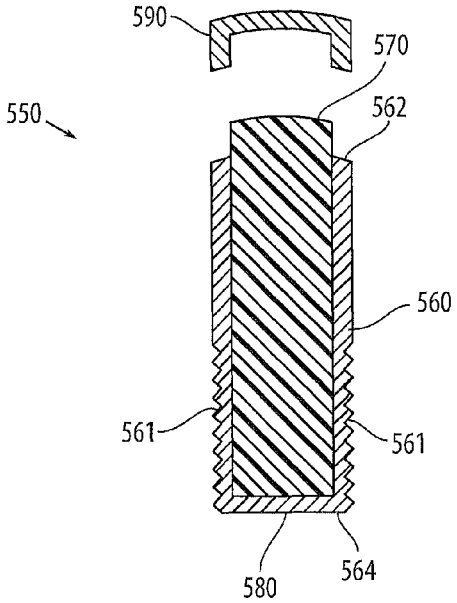
FIGS. 10-11 show an illuminated croquet ball according to a first embodiment.
Figure 11:
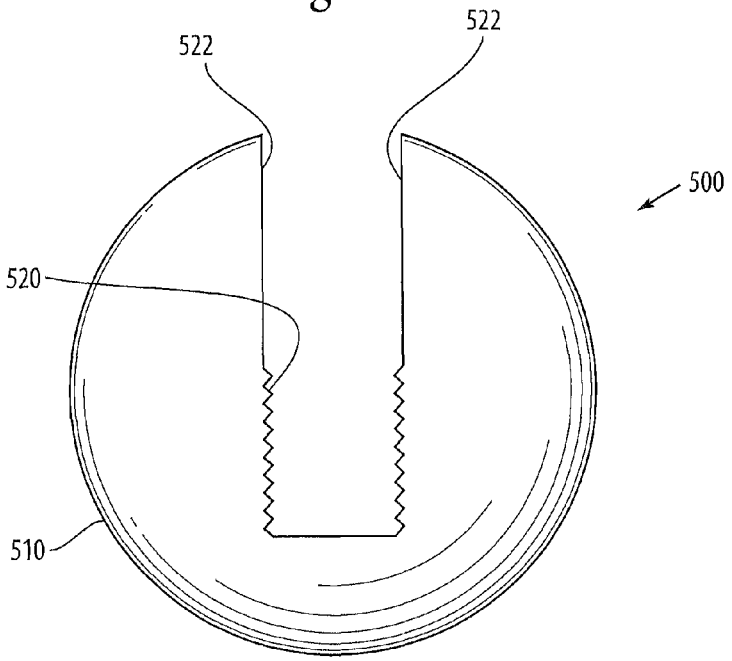
Figure 12:
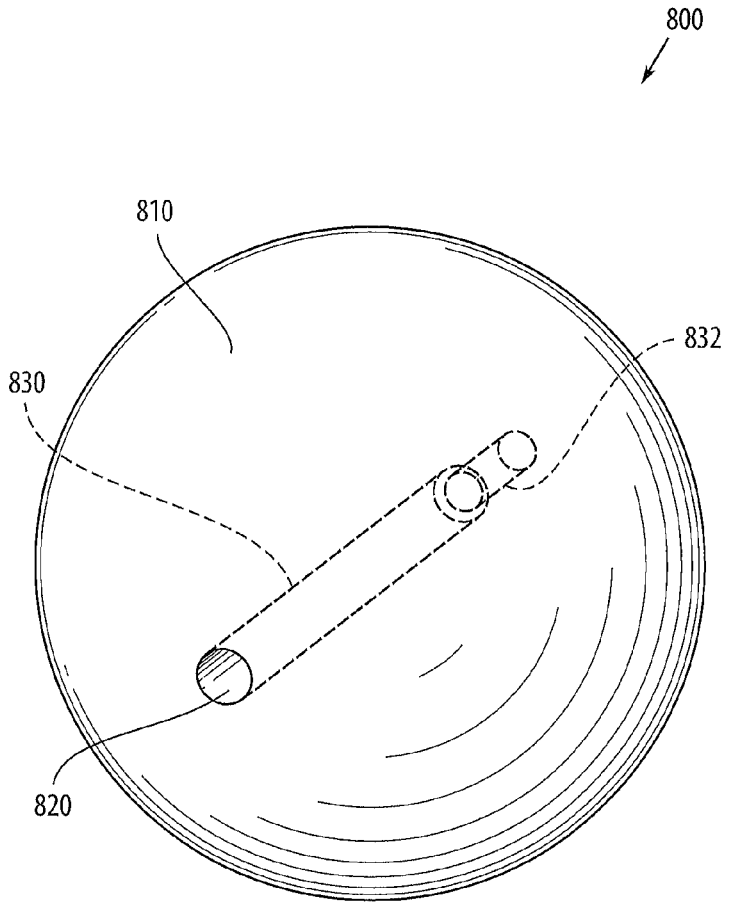
FIGS. 12-15 show an illuminated croquet ball according to a second embodiment.
Figure 13:
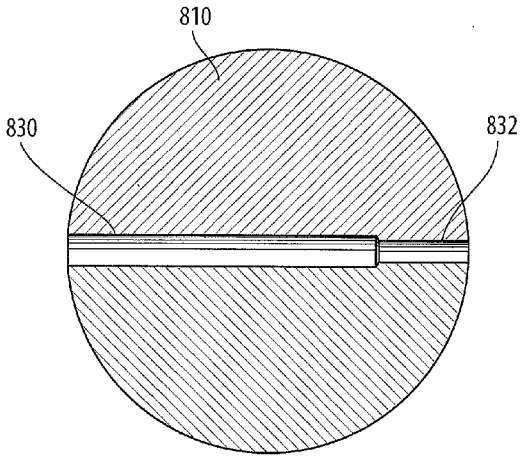
Figure 14:
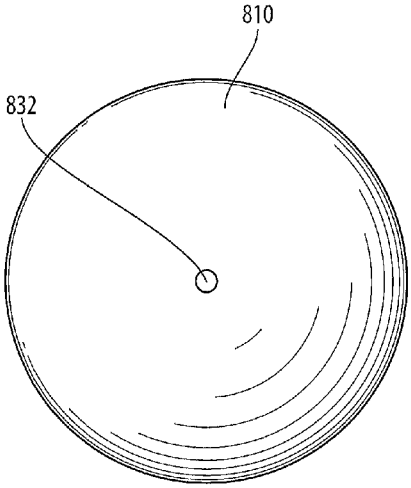
Figure 15:
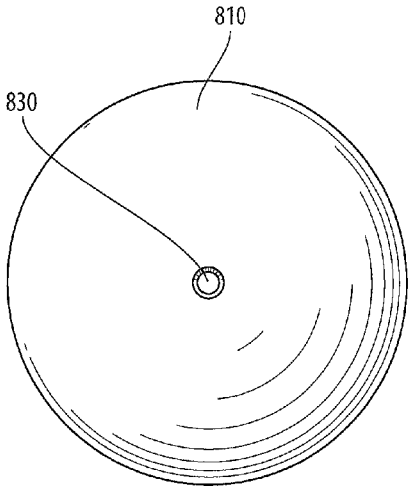

FIGS. 10-11 show another aspect of the present invention in that an illuminated ball 500 is shown. The illuminated ball 500 includes a body 510 that has a central bore 520 formed therein. The bore 520 is open along the outer surface of the body 510; however, the bore 520 does not extend completely through the body 510. The bore 520 can include a threaded portion 522 at least near the open end of the bore. The body 510 can be formed of a transparent or semi-transparent material or even an opaque material. In one embodiment, the body 510 can be formed of a clear transparent material. The body 510 can also be formed of a material that includes a glow-in-the-dark property in one of the materials used to form the body 510 has glow-in-the-dark properties (i.e., phospherescene materials).

The ball 500 includes a light source insert 550 that is removably disposed within the bore 520. In particular, the insert 550 can be in the form of a casing or housing 560 and a light source element 570 that is securely received within the housing 560. In one embodiment, as illustrated, the housing 560 is an elongated hollow structure with an open first end 562 and a closed second end 564. The housing 560 can have any number of different shapes including but not limited to a cylindrical, tubular structure.

The housing can be formed of any number of different materials, including plastics, etc. In addition, the housing 560 can additional internal material, such as internal padding (neoprene, etc.) that snugly holds the light source element 570. The housing 560 can include a complementary cap 590 that mates with the housing 560 to securely capture and hold the light source element 570. The cap 590 can be designed to fasteningly or frictionally attach to the open first end of the housing 560. Thus, the cap 590 can have external threads that mate with the threads of the housing 560. The cap 590 can be color coded to indicate the color of the light source element 570 when it is actuated.

The housing 560 includes outer threads 561 that mate with the threads 522 formed in the bore 520 to allow the housing 560 to be securely captured within the bore 520.

The light source element 570 can be any number of different structures including a flashlight (e.g., an LED flashlight) or a light stick or glow stick, which are all commercially available. In one embodiment, the light source element 570 is in the form of a 1.5 inch LED (e.g., military grade) and in another embodiment, 1.5 inch glow sticks are used. The light source element 570 is actuated and then placed in the bore 520. Then the cap 590 is secured to the housing 560.

As is know, a light stick or glow stick generates light based on chemiluminesence in which energy from a chemical reaction is used to emit light. A typical commercial light stick holds a hydrogen peroxide solution and a solution containing a phenyl oxalate ester and a fluorescent dye.

When actuated, the light source element 570 illuminates in a color and illuminates the surrounding ball 500 such that the ball 500 assumes this color. It will be appreciated that a set of balls 500 can be provided and can come in different colors or numbers.

At the closed second end 564, a means 580 is provided for removing the insert 550 from the body 510. For example, the means 580 can be in the form of a coin slot formed in the second end such that the insert can be rotated by inserting a coin and rotating the insert to cause unscrewing of the insert relative to the ball body.

In another embodiment, a light source element can be associated and affixed to one or more pins 100. For example, an LED or a glow stick can be hung from the flag (or flag support) or the shaft portion 200. The light source element thus illuminates the pin 100 and flag and allows nighttime play especially when used with the illuminated balls discussed herein. Glow sticks are an easy light source that include no moving parts and electronics and they are disposable. In addition, the player can simply leave the glow sticks attached to the pins 100 and inside the balls 500 since there is no need to turn these items off after use. Collection and removal of the glow sticks can occur the next day.

FIGS. 12-15 show another aspect of the present invention in that an illuminated ball 800 is shown. The illuminated ball 800 includes a body 810 that has a central bore 820 formed therein. The body 810 can be formed of the same materials used to form body 510. The body 810 can also be formed of a material that includes a glow-in-the-dark property in one of the materials used to form the body 810 has glow-in-the-dark properties (i.e., phospherescene materials).

The bore 820 is open along the outer surface of the body 810 at two opposing locations thereof. In accordance with this embodiment, the bore 820 does not have the same width (diameter) along its entire length but instead, the bore 820 is defined by two sections, namely a first section 830 and a second section 832 that is adjacent thereof and together form a continuous bore. The first section 830 has a first width (diameter) and the second section 832 has a second width (diameter) and as shown, the lengths of the two sections 830, 832 can be different and in fact, the second section 832 has a smaller length for reasons discussed below.

The first section 832 is sized and configured to slidingly receive a light source, such as a glow stick or other light source as discussed above. More specifically, the light source (e.g., light stick/glow stick) is inserted into the open end of the first section 832 and is frictionally held therein due to the light source being of substantially the same diameter (being slightly less than the diameter of the first section 832). The light source can be slid into the first section 830 until it reaches a stop (shoulder) 835 that is formed at the interface between the sections 830, 832. The length of the light source is preferably less than length of the first section 830 so as to prevent the light source from protruding from the open end of the section 830.

The diameter of the first section 832 can be about ¼ inch, while the diameter of the second section 834 can be about ⅛ inch and the glow stick can be ¼ inch in width and 1.5 inches in length.

The second section 832 is designed to receive a tool (elongated pin, rod or the like) that is passed through the bore section 832 and into contact with the light source to permit the light source be driven in a direction away from the second section 832. The tool thus allows the light source to be removed from the body 810 by sliding the light source back out of the open end of the first section 830 to permit the user to grasp and remove the light source.

Figure 16A:
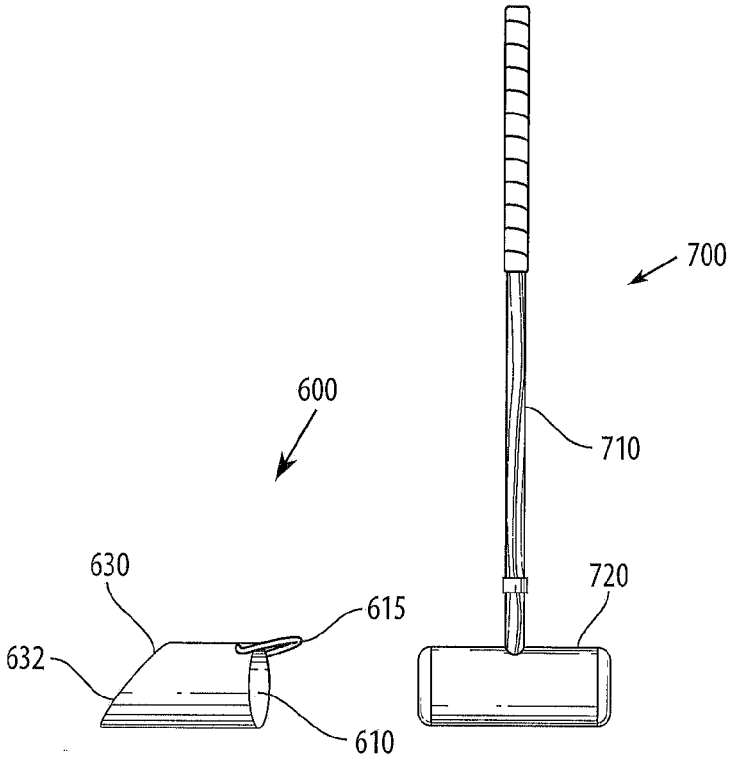
FIGS. 16A and 16B show various illustrations of a mallet for use in the present invention.
Figure 16B:
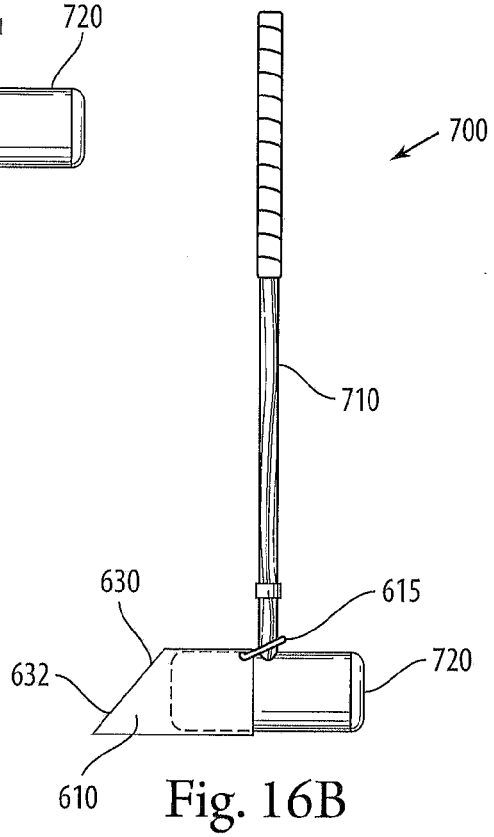

FIGS. 16A and 16B show an accessory 600 for use with a mallet 700. As is known, the mallet 700 includes an elongated shaft 710 and has a head 720. The accessory 600 is in the form of a chipping member for coupling to the mallet 700. The head 720 of the mallet 700 is typically a cylindrically shaped member. The accessory 600 is a partially hollow structure that includes a sheath (hollow) section 610 that has an interior space for receiving one end of the head 720 and an adjacent solid angled end 630 that has an angled surface (face) 632 that represents a ball striking surface that is suited for chipping.

The accessory 600 is secured to the mallet 700 using conventional means including the use of a mechanical fastener 615, such as a hook and loop fastener, that wraps around the mallet 700.

The sheath section 610 can be formed of any number of different materials including but not limited to a plastic material (e.g., PVC material) or rubber material. In one embodiment, the sheath section 610 can be an expandable member in that the sheath section 610 can be inflated or the like after insertion of the mallet into the sheath section 610 to cause a secure fit of the mallet into the sheath section 610. For example, a rubber seal (gasket) can be disposed at one end and a pressure release valve can be provided near the angled solid end 630. When the valve is closed, the accessory 600 cannot be removed from the mallet 700 but when pressure is released, the accessory 600 can be slid off the mallet 700.

The accessory 600 slides onto the mallet 700 for purposes of chipping. The accessory 600 can be removed easily and attached to a belt of the player using the means 615.

The accessory 600 can be twisted for lefty, righty, short, tall, angled or head-on.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A pin for a lawn game comprising:

a shaft portion that includes a first end and a second ground contact end;

a first fence part that is fixedly attached to the shaft portion and radially extends outwardly from the shaft portion;

a second fence part that is rotatably attached to the shaft portion and radially extends outwardly from the shaft, the second fence part being sized such that at least a portion of the second fence part is disposed within confines of the first fence part, the second fence part being rotatable relative to the fixed first fence part to allow the second fence part to be positioned at a desired angle, including a right angle, relative to the first fence part;

a flag disposed at the first end of the shaft portion; and wherein the first fence part includes two spaced leg portions and top and bottom spaced cross supports that extend between the leg portions and define an interior space.

2. The pin of claim 1, wherein the second fence part includes two spaced leg portions and top and bottom spaced cross supports that extend between the leg portions, wherein the top and bottom cross supports of the second fence part are disposed in the interior space.

3. The pin of claim 1, wherein the shaft portion and first and second fence parts are formed of metal.

4. The pin of claim 1, further including a bell and a flag supported by the shaft portion.

5. The pin of claim 1, wherein a bottom end of the shaft portion is threaded for insertion into a ground surface.

6. The pin of claim 2, wherein the leg portions of the first fence parts include opposing retaining members for receiving and holding the leg portions of the second fence part.

7. The pin of claim 6, wherein the retaining members comprise two tubular structures that receive the leg portions of the second fence part.

8. A pin for a lawn game comprising:

a shaft portion that includes a first end and a second ground contact end;

a first fence part that is fixedly attached to the shaft portion and radially extends outwardly from the shaft portion;

a second fence part that is rotatably attached to the shaft portion and radially extends outwardly from the shaft, the second fence part being sized such that at least a portion of the second fence part is disposed within confines of the first fence part, the second fence part being rotatable relative to the fixed first fence part to allow the second fence part to be positioned at a desired angle, including a right angle, relative to the first fence part; and wherein the first fence part includes two spaced leg portions and top and bottom spaced cross supports that extend between the leg portions and define an interior space; and a flag disposed at the first end of the shaft portion; and wherein the second fence part includes two spaced leg portions and top and bottom spaced cross supports that extend between the leg portions, wherein the top and bottom cross supports of the second fence part are disposed in the interior space;

wherein free bottom ends of the leg portions of the second fence part are disposed on opposite sides of the bottom cross support of the first fence part.

9. A pin for a lawn game comprising:

a shaft portion that includes a first end and a second ground contact end;

a first fence part that is fixedly attached to the shaft portion and radially extends outwardly from the shaft portion;

a second fence part that is rotatably attached to the shaft portion and radially extends outwardly from the shaft, the second fence part being sized such that at least a portion of the second fence part is disposed within confines of the first fence part, the second fence part being rotatable relative to the fixed first fence part to allow the second fence part to be positioned at a desired angle, including a right angle, relative to the first fence part;

a flag disposed at the first end of the shaft portion; and a bottle opener device that is securely attached to, yet removable from a top end of the shaft portion.

10. The pin of claim 9, wherein the top end of the shaft portion is threaded and the bottle opener is threaded for mating together.

* * * * *